US007803002B2

(12) United States Patent
Tan

(10) Patent No.: US 7,803,002 B2
(45) Date of Patent: Sep. 28, 2010

(54) HUB

(76) Inventor: Yi Tan, Building 5, Penghua Industrial Park, Heping Rd (W), Longhua, Bao'an District, Guangdong Province, Shenzhen (CN)

( * ) Notice: Subject to any disclaimer, the term of this patent is extended or adjusted under 35 U.S.C. 154(b) by 24 days.

(21) Appl. No.: 12/300,572

(22) PCT Filed: Jul. 12, 2007

(86) PCT No.: PCT/CN2007/002144

§ 371 (c)(1),
(2), (4) Date: Nov. 12, 2008

(87) PCT Pub. No.: WO2008/122161

PCT Pub. Date: Oct. 16, 2008

(65) Prior Publication Data

US 2009/0163057 A1 Jun. 25, 2009

(30) Foreign Application Priority Data

Apr. 5, 2007 (CN) ..... 2007 2 0119382 U

(51) Int. Cl.
*H01R 13/44* (2006.01)

(52) U.S. Cl. ..... 439/144

(58) Field of Classification Search ..... 439/143, 439/144, 142, 147, 76.1
See application file for complete search history.

(56) References Cited

U.S. PATENT DOCUMENTS 5,603,623 A * 2/1997 Nishikawa et al. ..... 439/144
2005/0020105 A1* 1/2005 Chen ..... 439/76.1

FOREIGN PATENT DOCUMENTS

| | | |
|---|---|---|
| CN | 1656657 | 8/2005 |
| CN | 2797305 | 7/2006 |
| WO | 03/088430 | 10/2003 |

* cited by examiner

*Primary Examiner*—Phuong K Dinh
(74) *Attorney, Agent, or Firm*—Hamre, Schumann, Mueller & Larson, P.C.

(57) ABSTRACT

The present invention is available in hub technique field and provides a hub, which comprises a circuit board, a plug coupled to the circuit board, an upper cover and a bottom cover. The upper cover and the bottom cover cooperatively package the circuit board therein. The circuit board comprises at least one board socket facing toward the upper cover. The upper cover defines a first insertion opening disposed to be aligned with the board socket. The hub further comprises a rotating cover. The rotating cover is interposed between the upper cover and the circuit board and is coupled to and rotatable about the upper cover. The rotating cover defines a second insertion opening disposed to be aligned with the board socket. The rotating cover covers the board socket when the rotating cover is positioned at a first position. The first and the second insertion openings are in communication with each other to expose the board socket when the rotating cover is positioned at a second position. The present invention uses the rotating cover to cover the board socket when the hub is not in use, thereby preventing the hub from external corrosion. When use, the first and the second insertion openings become in communication with each other by rotating the rotating cover, thereby exposing the board socket to allow insertion of peripheral equipments. The entire process which it is easy and convenient to be operated.

7 Claims, 4 Drawing Sheets

HUB

FIELD OF THE INVENTION

The present invention relates to hub techniques and, more particularly to a hub for universal serial bus.

BACKGROUND

The universal serial bus (USB) interface is a new interface technology used in personal computer field. With the popularity of interface use in various relative products of computers and digital products, people require the computers can provide with more and more USB interfaces. Currently, due to the limitation of the number of available USB interfaces in the computers themselves, USB hubs are generally applied for adding the number of USB interfaces.

Currently, there are many kinds of USB hubs on the market. Most of sockets of the traditional USB hubs are exposed outside when the hubs are not in use. When exposed to air for a long time, the sockets are subjected be deteriorated due to corrosion of dust, water vapor, and a variety of chemical substance. This causes oxidation on the surface of metal connector sheets of the USB hub bases, and results in poor conduction, thereby producing bad influence on its function.

SUMMARY

An object of an embodiment of the present invention is to provide a hub to solve the problem of poor conduction resulting from exposing the sockets of the traditional hubs outside during no use of the hubs.

To achieve the above object, in accordance with an aspect of the present invention, a hub comprises a circuit board, a plug coupled to the circuit board, an upper cover and a bottom cover. The upper cover and the bottom cover cooperatively package the circuit board therein. The circuit board comprises at least one board socket facing toward the upper cover. The upper cover defines a first insertion opening disposed to be aligned with the board socket. The hub further comprises a rotating cover. The rotating cover is interposed between the upper cover and the circuit board, and is coupled to and rotatable about the upper cover. The rotating cover also defines a second insertion opening disposed to be aligned with the board socket. The rotating cover covers the board socket when the rotating cover is positioned at a first position. The first and the second insertion openings are in communication with each other to expose the board socket when the rotating cover is positioned at a second position.

Since the rotating cover is placed between the upper cover and the circuit board of the hub of the present invention, the rotating cover covers the board socket when the hub is not in use. When used, the first and the second insertion openings become in communication with each other by rotating the rotatable cover, thereby exposing the board socket. The entire process is readily operated and has a perfect industrial application. Further, the board socket is effectively protected.

DETAILED DESCRIPTION OF THE PREFERRED EMBODIMENTS

Objects, approaches and advantages of the present invention will be more apparent from the following detailed description of the embodiments with reference to the accompanying drawings. However, it is to be appreciated that the following description of the embodiment(s) is merely to explain the present invention and is no way intended to limit the present invention.

A rotating cover is interposed between the upper cover and the circuit board of the hub of the present invention. The rotating cover covers the board socket when the hub is not in use. When used, the first and the second insertion openings become in communication with each other by rotating the rotating cover, thereby exposing the board socket. The entire process is readily operated and has a perfect industrial application. Further, the socket is effectively protected.

Figure 1:
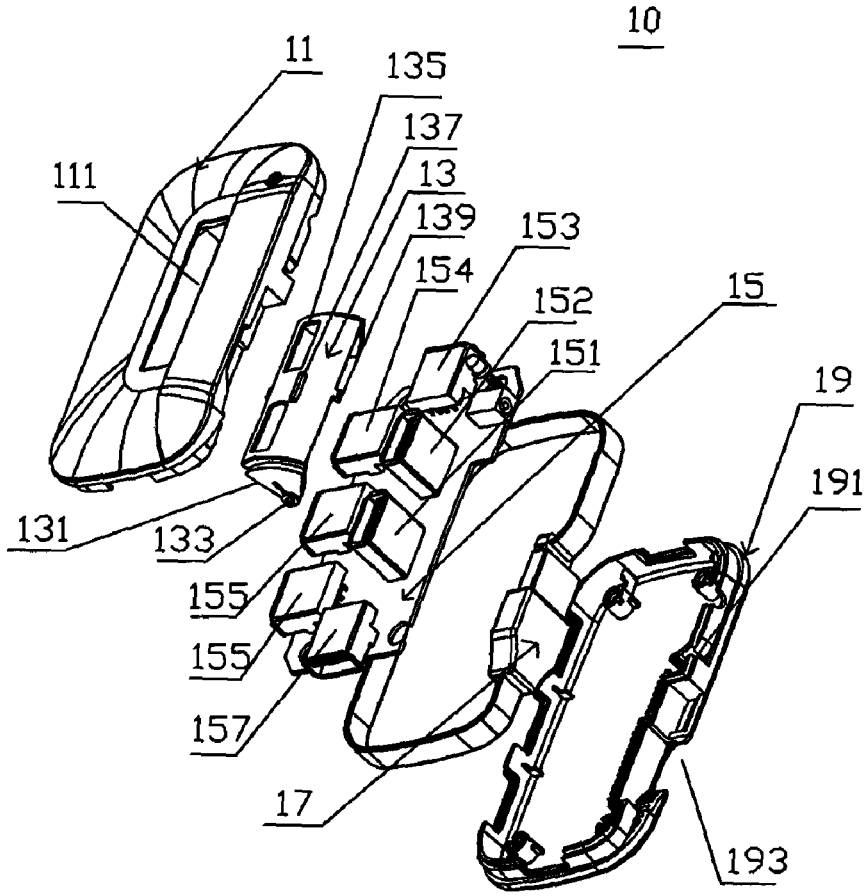
FIG. 1 is a schematic, disassembled view of a hub provided in accordance with an embodiment of the present invention.

Referring to FIG. 1, the hub of the embodiment of the present invention is a USB hub. The USB hub 10 includes an upper cover 11, a rotating cover 13, a circuit board 15, a plug 17, and a bottom cover 19. FIG. 1 illustrates that the plug 17 and a wire of the plug 17 is wrapped around a circumference of the USB hub 10.

Figure 2:
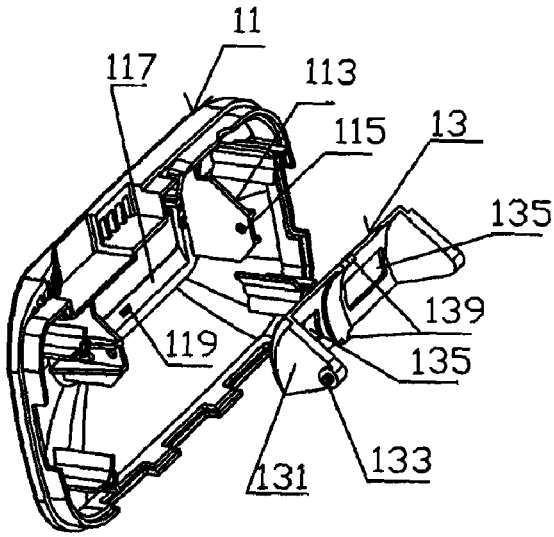
FIG. 2 is a schematic view of an upper cover and a rotating cover of the hub provided in accordance with the embodiment of the present invention.

Referring to FIG. 2, the upper cover 11 includes a rectangular insertion opening 111 disposed to be aligned with board sockets 151 and 152 of the circuit board 15. Two retainer sheets 113 are separately disposed at two sides of the insertion opening 111 and protrude inward. An end of each retainer sheet 113 is provided with a shaft hole 115. The rotating cover 13 defines an arcuated surface facing toward the upper cover 11. Two fixing sheets 131 extend from two ends of the arcuated surface. Shafts 133 are respectively disposed on the fixing sheet 131 and are correspond to the shaft holes 115. The retainer sheets 113 are used to clip the fixing sheets 131 and are in a rotatable connection with the fixing sheets 131 to cause the rotating cover 13 to rotate around the upper cover 11. Apparently, the upper cover 11 and the rotating cover 13 could be connected to each other by other rotating connection means. For example, the shaft holes are defined in the fixing sheets 131 and the shafts are disposed on the retainer sheets 113. Alternatively, the upper cover 11 and the rotating cover 13 could be in a rotatable connection by other rotating connection mechanism.

An upper portion and a lower portion of the insertion opening 111 of the upper cover 11 separately define a slant surface 117 which is inclined inward. Each slant surface 117 defines a recess 119. Two locating members 139 are disposed at edges of the arcuated surface of the rotating cover 13 and are used to snap into the recess 119 to achieve detent action of the hub 10. The slant surface 117 has an inclined angle corresponding to a slope angle of the arcuated surface to aid in rotation of the arcuated surface.

The arcuated surface of the rotating cover 13 defines two insertion openings 135 aligned with the board sockets 151 and 152 of the circuit board 15. A protrusion 137 projects out of a convex surface of the arcuated surface along a direction facing toward the upper cover 11. The protrusion 137 is positioned between the two insertion openings 135 to facilitate operation of the rotating cover 13.

The bottom cover 19, the circuit board 15 and the upper cover 11 cooperatively define a connection mechanism for attaining assembly of the hub 10.

Figure 3:
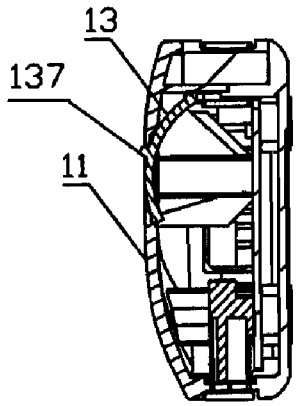
FIG. 3 is a schematic, cutaway of the assembled hub in accordance with the embodiment of the present invention.
Figure 4:
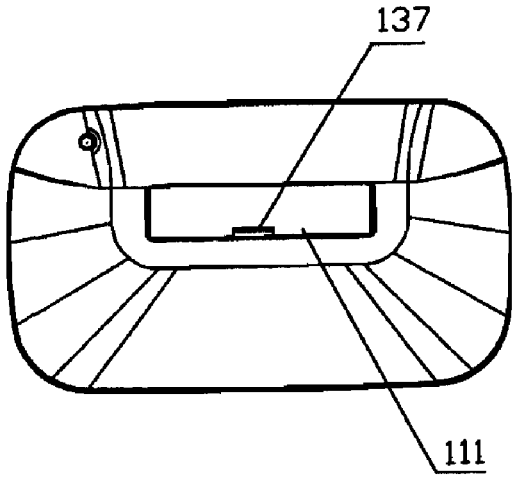
FIG. 4 is a schematic, front side view of the assembled hub in accordance with the embodiment of the present invention.
Figure 5:
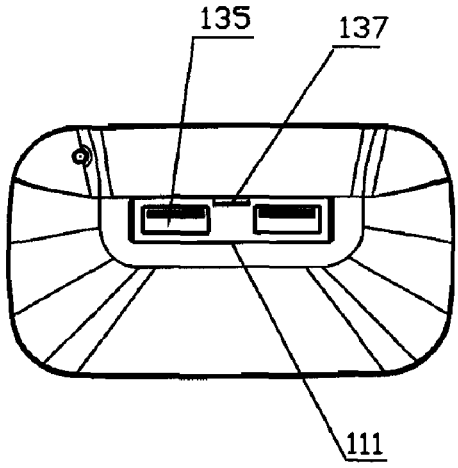
FIG. 5 is a schematic, front side view of the hub in accordance with the embodiment of the present invention, showing that the rotating cover communicates with the upper cover to expose the socket outside.

As shown in FIGS. 3 and 4, after assembling of the hub 10 of the embodiment of the present invention, the retainer sheets 113 of the upper cover 11 clip the fixing sheets 131 of the rotating cover 13. The shafts 133 are pivotally coupled to the shaft holes 115, thereby causing the rotating cover 13 to be connected to and rotatable about the upper cover 11. Meanwhile, the protrusion 137 projects out of the insertion opening 111 of the upper cover 11. The arcuated surface of the rotating cover 13 seals the insertion opening 111. The insertion openings 135 of the rotating cover 13 are not in communication with the insertion opening 111 of the upper cover 11 so that the board sockets 151 and 152 of the circuit board 15 are not exposed. As shown in FIG. 5, when the protrusion 137 of the rotating cover 13 is pushed upward by an external force, the arcuated surface of the rotating cover 13 slides along the slant surface 117 of the upper cover 11. The locating member 139 of the rotating cover 13 is inserted into the recess 119 in the slant surface 117 to achieve fixation thereof. Accordingly, the insertion openings 135 of the rotating cover 13 are in complete communication with the insertion opening 111 of the upper cover 11 to facilitate smooth insertion of external plugs into the board sockets 151 and 152 of the circuit board 15, thereby achieving normal application.

Figure 6:
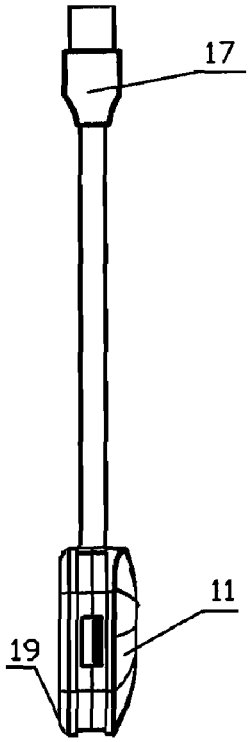
FIG. 6 is a schematic view of the assembled hub, by showing a plug and a wire in an unwrapped status.
Figure 7:
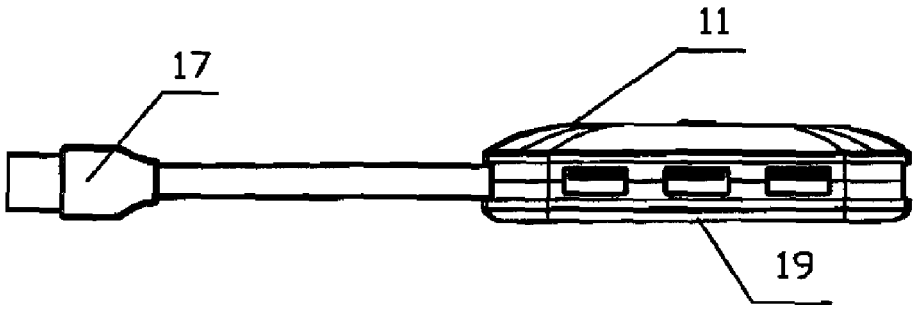
FIG. 7 is a schematic view of the assembled hub, by showing the plug and the wire in the unwrapped status at another view angle.
Figure 8:
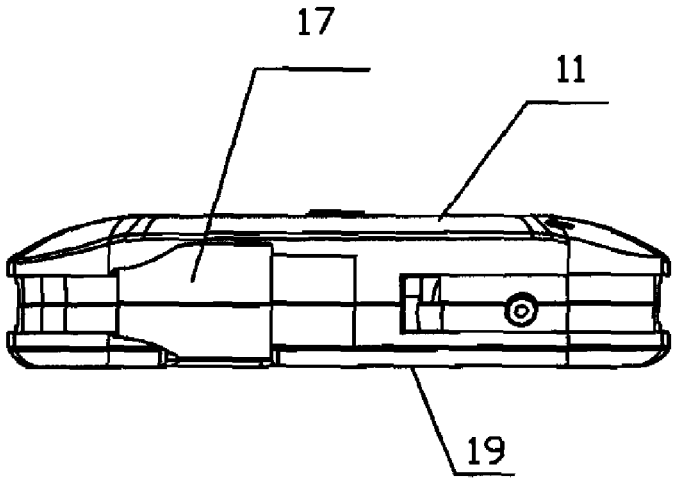
FIG. 8 is a schematic view of the assembled hub, but showing the plug and the wire in a wrapped status.

As shown in FIGS. 6, 7 and 8, after the above USB hub 10 is assembled, the upper cover 11 combined with the bottom cover 19 forms the openings corresponding to the board sockets 153 to 157 of the circuit board 15. Peripheral equipments can be inserted into the board sockets 153 to 157 of the circuit board 15 through the openings. A wire of the plug 17 is leaded out via an exit 191 defined in a side of the USB hub 10. After the wire is wrapped around a whole circumference of the USB hub 10, the plug 17 is secured in the plug receiving groove 193 formed by the upper cover 11 cooperating with the bottom cover 19. The plug receiving groove 193 is adjacent to the exit 191. The plug receiving groove 193 is in a shape matching with shape of the plug 17. The wire of the plug 17 may be in a flattened form and define a width of more than that of the openings corresponding to the board sockets 153 to 157. The wire of the plug 17 has a length such that the plug 17 is secured in the plug receiving groove 193 after the wire is wrapped around the circumference of the USB hub 10. As such, the flattened wire can seal the openings defined in the side of the USB hub.

After the USB hub 10 is assembled, the openings corresponding to the board sockets 153 to 157 of the circuit board 15 are exposed outside when the openings are not in use. After the wire of the plug 17 is wrapped around the circumference of the USB hub 10 and then the plug 17 is secured in the plug receiving groove 193, the wire seals the openings corresponding to the board sockets 153 to 157. The openings are exposed outside when the wire is unwrapped.

Furthermore, the configuration of the rotating cover or the winding of the wire may be separately applied in the USB hub according to the actual number and distribution of the openings.

The USB hub of the embodiment of the present invention, provided with a number of nonuniformly distributed openings, uses the rotating cover or the winding means of the wire for sealing the openings thereof to prevent the openings from corrosion of dust, water vapor, and a variety of chemical substance in the atmosphere. This forms a protection for the opening and facilitates accommodation of the wire, thereby achieving a compact structure and a perfect operatability.

Herein described embodiments are preferred embodiments of the present invention but it should not be construed as limiting the overall scope of the present invention. It will be apparent that various modifications, replacements and variations may be made in the present invention without departing from the spirit or scope of the present invention.

What is claimed is:

1. A hub comprising:

a circuit board;

a plug coupled to the circuit board, wherein the plug is a flattered wire;

an upper cover; and a bottom cover, the upper cover and the bottom cover cooperatively packaging the circuit board therein, wherein the circuit board comprises at least one board socket facing toward the upper cover, the upper cover defining a first insertion opening disposed to be aligned with the board socket;

wherein the hub further comprises a rotating cover interposed between the upper cover and the circuit board, the rotating cover being coupled to and rotatable about the upper cover, the rotating cover defining a second insertion opening disposed to be aligned with the board socket, the rotating cover covering the board socket when the rotating cover is positioned at a first position, the first and the second insertion openings being in communication with each other to expose the board socket when the rotating cover is positioned at a second position;

wherein the circuit board further comprises at least one side board socket facing toward a side of the hub, a third insertion opening aligned with the side board socket being formed in the side of the hub, the side of the hub defining an annular groove for receiving the flattened wire to cover the third inserting opening.

2. The hub as claimed in claim 1, wherein the rotating cover comprises an arcuated surface and fixing sheets extending from ends of the arcuated surface, the second insertion opening being defined in the arcuated surface, the upper cover comprising retainer sheets in rotatable connection with the retainer sheets of the upper cover.

3. The hub as claimed in claim 2, wherein a protrusion extends from the arcuated surface of the rotating cover and projects out of the upper cover, for causing rotation of the rotating cover.

4. The hub as claimed in claim 2, wherein the upper cover further comprises a slant surface to be auxiliary for rotation of the rotating cover, the slant surface defining an inclined angle in correspondence to the arcuated surface.

5. The hub as claimed in claim 4, wherein the slant surface defines at least one recess, the arcuated surface defining at least one locating member in correspondence to the recess.

6. The hub as claimed in claim 5, wherein the locating member is a protrusion disposed at edge of the arcuated surface.

7. The hub as claimed in claim 1, wherein the side of the hub further defines a plug receiving groove.

* * * * *